United States Patent [19]

Moscovitch

[11] Patent Number: 4,770,191

[45] Date of Patent: Sep. 13, 1988

[54] CIGARETTE MAKING MACHINE

[76] Inventor: Herman Moscovitch, 2359 de Maisonneuve Blvd. E., Montreal, Quebec H2K 2E6, Canada

[21] Appl. No.: 893,944

[22] Filed: Aug. 6, 1986

Related U.S. Application Data

[63] Continuation of Ser. No. 611,724, May 18, 1986, abandoned.

[51] Int. Cl.[4] ..... A24C 5/02; A24C 5/42

[52] U.S. Cl. ..... 131/75; 131/70

[58] Field of Search ..... 131/70, 71–79, 131/81.1, 82, 84.1, 84.4; 30/204, 208

[56] References Cited

U.S. PATENT DOCUMENTS

| | | | |
|---|---|---|---|
| 3,127,900 | 4/1964 | Kastner | 131/70 |
| 3,886,952 | 6/1975 | Kastner | 131/70 |
| 4,005,716 | 2/1977 | Messner et al. | 131/70 |
| 4,167,948 | 7/1979 | Moscovitch | 131/70 |
| 4,411,278 | 10/1983 | Kastner | 131/70 |

*Primary Examiner*—V Millin

*Attorney, Agent, or Firm*—Robert J. Schaap

[57] ABSTRACT

There is disclosed improvements in cigarette making machines for filling preformed paper cigarette tubes with tobacco wherein the machine has improved means for shearing any loose tobacco placed in the cavity wherein it is compacted, the improved shearing resulting from pressure maintained on the cutting edges.

25 Claims, 3 Drawing Sheets

CIGARETTE MAKING MACHINE

This application is a continuation of Ser. No. 06/611,724 filed 5/18/86 now abandoned.

The present invention relates to a machine for filling preformed paper cigarette tubes with tobacco and more particularly, relates to improvements therein.

Cigarette-making machines which are adapted to take loose tobacco, compact the same, and inject the compacted tobacco in preformed paper cigarette tubes are well known. One may refer to U.S. Pat. No. 4,167,948 issued Sept. 18, 1979 to Moscovitch which teaches such a machine. One may also refer to U.S. Pat. Nos. 3,741,200; 3,127,900; and 3,886,952, all of which illustrate machines for filling the preformed paper cigarette tubes.

Generally, for reasons of economy and ease of manufacture, such machines are formed of a plastic material. Inherent in the operation of such machines is the filling of a cavity or chamber in the machine with loose tobacoo, the compaction of the tobacoo (usually mechanically assisted) into a plug of tobacco, and insertion of the tobacco into the paper tube. During the compaction of the tobacco, frequently excess tobacco may protrude from the chamber and if the tobacco is not cleanly cut, it may interfere with the satisfactory operation of the machine and the production of a satisfactory cigarette. As aforementioned, the machines are usually formed of a plastic material and a "clean" cutting of the tobacco does not always occur.

With this invention there is provided a machine or apparatus for filling prefabricated hollow paper cigarette tubes in which the machine has means for effectively cutting any tobacco which may protrude from the tobacco-receiving chamber during the compaction of the tobacco.

There is also provided a machine for filling prefabricated hollow paper cigarette tubes wherein the cutting means, which comprises a pair of cutting edges, is adapted to act in a dual scissors-like action so as to effectively cut all protruding tobacco.

There is also provided a cigarette machine for use with loose tobacco and preformed hollow cigarette paper tubes which has means to maintain pressure on the cutting edges for cutting protruding tobacco despite normal manufacturing tolerances during the manufacturing process.

The improvements of the present invention may be utilized with many conventional machines and thus, one may incorporate the improvements in a single-lever machine or in the alternative, in a two-lever machine, wherein a first lever causes compaction of the loose tobacco into an elongated cylindrical form with movement of the second lever causing injection of the compacted tobacco into a preformed hollow cigarette paper tube.

In operation, the machine has a cavity or a chamber formed in its body portion with a compacting member mounted for sliding movement within the body such that it will compact the tobacco which is placed in the chamber into an elongated cylindrical form. During the compaction movement, the compacting member will move from a first open position to a second closed position, closing off the opening into which the loose tobacco is placed. During this sliding movement, one edge of the tobacco compacting member is designed to shear any tobacco protruding from the chamber, the compacting member edge acting in conjunction with an edge defining the cavity or chamber. In a preferred embodiment of the present invention, the edge defining the chamber of cavity has a slight V-shaped configuration such that a double-scissor action is obtained between the two cutting or shearing edges.

One aspect of the present invention provides a compacting member which is bevelled slightly upwardly from its sides towards the center at least along the shearing edge. This bevelled configuration, in conjunction with the design of the body portion, is adapted to ensure that good contact is made between the two shearing edges to effectively cut any excess tobacco protruding from the chamber.

The present invention also provides an embodiment wherein the compacting member is designed to always maintain a pressure at the two cutting or shearing edges despite normal manufacturing tolerances. In this respect, one embodiment of the invention employs a compacting member wherein the lower leading edge of the member is somewhat flexible and is manufactured to be slightly larger than the cavity into which it is designed to fit such that a desired pressure is maintained.

The present invention further provides an improved nozzle member which eliminates jamming of the tobacco which could occur during insertion of the compacted tobacco into the tube.

Having thus generally described the invention, reference will be made to the accompanying drawings illustrating an embodiment thereof, in which.

Figure 1:
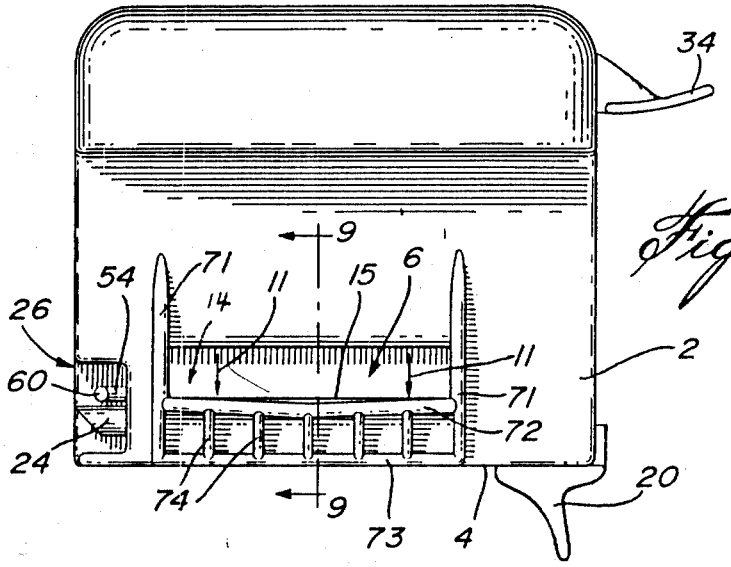
FIG. 1 is a top view of the external appearance of a machine according to the present invention.
Figure 2:
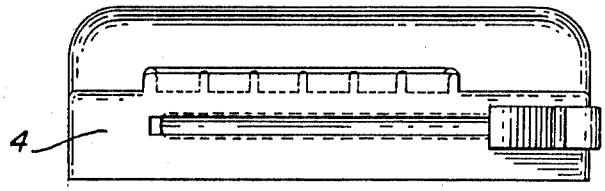
FIG. 2 is a front elevational view of the machine of FIG. 1.
Figure 3:
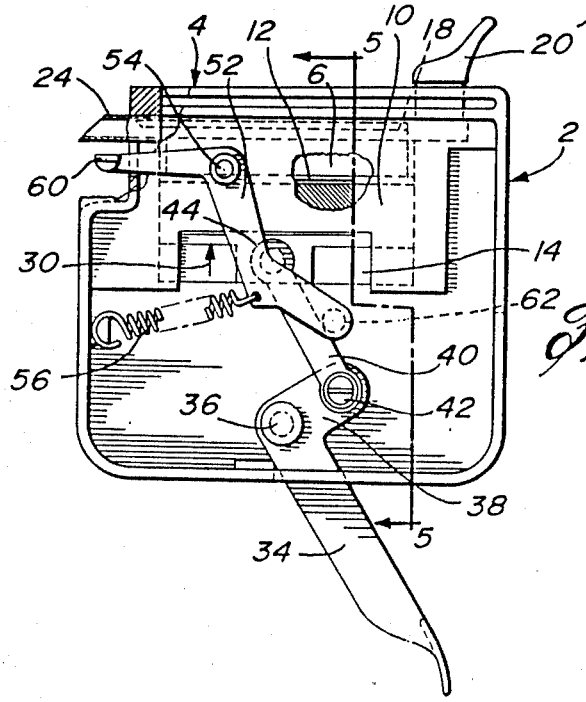
FIG. 3 is a bottom plan view, partially in cutaway, of the machine when the machine is adapted to receive loose tobacco.
Figure 4:
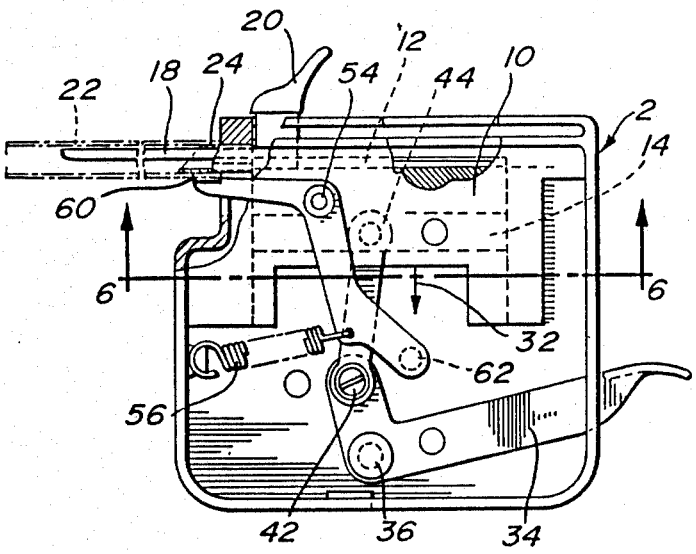
FIG. 4 is a bottom plan view, with a partial cutaway view, similar to FIG. 3 illustrating the machine when the loose tobacco has been compacted.

The particular machine shown has a body or casing unit 2 having on its upper surface adjacent the front edge 4 of the machine an elongated aperture 6 for receiving a supply of tobacco as will be described in greater detail hereinbelow. The opening 6 opens into a chamber 8 defined by a bottom 10 (see FIG. 5), a leading upper concave surface portion of a spoon member 18. The spoon member 18 is secured to a spoon handle 20 and the spoon handle 20 and spoon member 18 are movable from their positions as shown in FIGS. 1 and 3, to a tobacco injecting position as shown in FIG. 4 to inject a wad of tobacco into a cigarette tube (which is shown at 22 in broken lines in FIG. 4) and which is positioned on a nozzle 24 which is rigidly secured to the casing 2. The nozzle 24 may be positioned within a corner cutout portion 26 of the casing as shown in FIG. 1.

Figure 5:
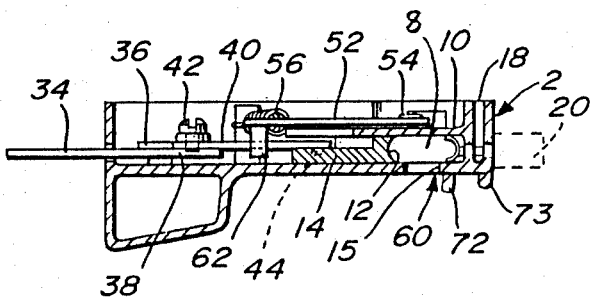
FIG. 5 is a sectional view taken along the lines 5—5 of FIG. 3.

The bottom 10 defining chamber 8 is secured to the casing 2 and as shown in FIGS. 3, 4 and 5, tobacco compacting member 14 having concave leading edge 12 is positioned for reciprocal movement in accordance with the arrows 30 and 32 in FIGS. 3 and 4 (or arrows 11 in FIG. 1), respectively, with this reciprocal movement being dependent upon the actual positioning and movement of the main operating lever 34.

The operating lever 34 is pivotally carried by the casing 2 by means of screw or stud 36. The lever 34 is of bell-crank lever configuration and the inner angled arm 38 of the lever 34 is pivotally secured to a link member 40 by means of pivot 42. The other end of the link 40 is pivotally secured to the tobacco compacting member 14 by means of pivot 44, and it will be appreciated that movement of lever 34 from the position shown in FIG. 3 to the lateral position shown in FIG. 4 will cause movement of the tobacco compacting member from the "open" position shown in FIG. 3 to the "closed" position shown in FIG. 4 whereby tobacco positioned in the chamber 8 through opening 6 will be compacted against the concave spoon 18 to form a cylindrical rod of tobacco (not shown) ready for injection into a tube 22 positioned on nozzle 24.

Figure 6:
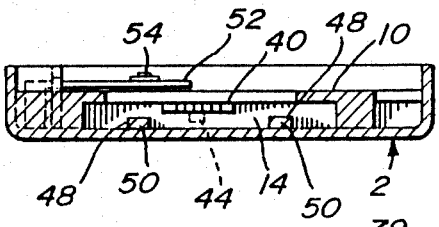
FIG. 6 is a sectional view taken along the lines 6—6 of FIG. 4.

Parallel slots 48 (see FIG. 6) may be provided in compacting member 14 and by providing guides in the form of downwardly projecting studs 50 on the lower surface of the casing 2, it will be appreciated that the slots move along the guides during movement of the lever to maintain the tobacco compacting member 14 in precise alignment with the concave spoon member 18 and between which the wad of tobacco is compacted.

In operation the user pivots the operating lever 34 to the position shown in FIG. 3 which withdraws the tobacco compacting member 14 to the "open" position shown in this view. The handle 20 and spoon 18 will also be moved to the position shown in FIG. 3 so that the chamber is ready for the reception of a supply of tobacco. After the tobacco is positioned in the chamber, the lever 34 is then pivoted to the position shown in FIG. 4, whereby the tobacco (not shown) is compacted in cylindrical rod form between the concave leading edge 12 of the compacting member 14 and the concave spoon 18. Handle 20 is then moved to the position shown in FIG. 4 whereby the compacted wad of tobacco is injected into a tube 22 previously positioned on the nozzle 24.

To retain the tube 22 on the nozzle during injection a tube retaining lever 52 is provided. The lever 52 is also of bell-crank configuration and is secured for pivotal movement to the bottom surface of the bottom 10 by means of pivot 54. A spring 56 extends between the side of the casing and the lever 52 and the action of the spring is to normally hold the tip 60 on the outermost end of the lever 52 against the nozzle 24. The innermost end of the lever 52 is provided with a stud 62 which is positioned to be contacted by the link 40. When the handle 34 is in the position shown in FIG. 3, the stud 62 is contacted by the link 40 and the lever 52 is pivoted against the action of spring 56 to the position shown in FIG. 3 wherein the tip 60 is removed from the nozzle 24. It is in this position that a tube 22 will be positioned on the nozzle 24. When the handle 34 is moved to the tobacco compacting position as shown in FIG. 4, however, spring 56 is then able to move the lever 52 to the tube retaining position shown in FIG. 4.

In operation and as may be seen from FIG. 5, during the movement of the tobacco compacting member from a first open position to a second closed position, a leading edge of concave surface 12 will contact edge 15 of body unit 2 to cut any protruding tobacco.

Figure 10:
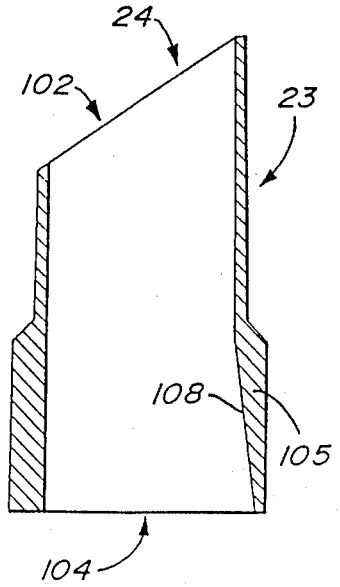
FIG. 10 is a sectional view of the nozzle.
Figure 11:
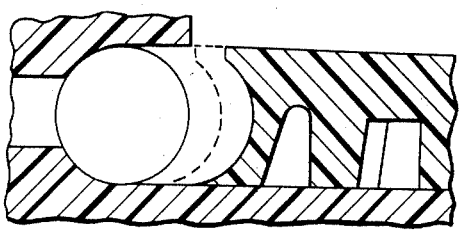

Nozzle 24, as shown in FIG. 10, has a discharge end generally indicated by reference numeral 102 and an inlet end indicated by reference numeral 104. As may be seen from FIG. 10, a portion of wall 105 is tapered as indicated by reference numeral 108 such that when the tobacco is inserted in nozzle 24 at inlet end 104, no "snagging" can occur since the wall is tapered inwardly to smoothly guide the tobacco.

Figure 7:
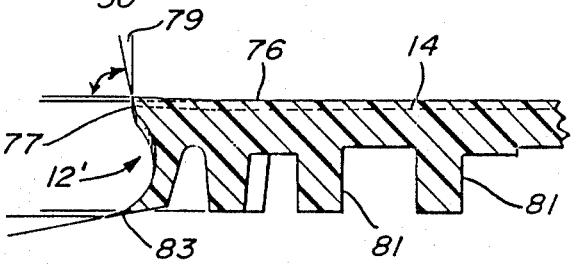
FIG. 7 is a side sectional view of a portion of the compacting member.
Figure 8:
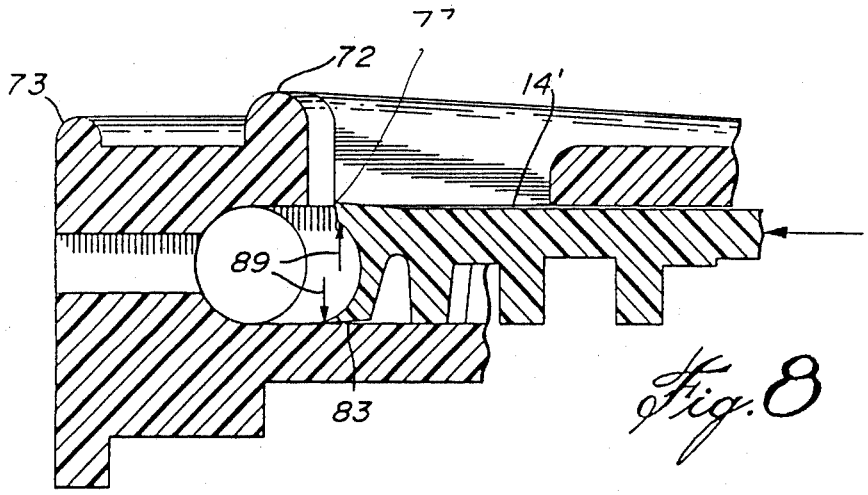
FIG. 8 is a cross-sectional view taken along the lines 8—8 of FIG. 1.
Figure 9:
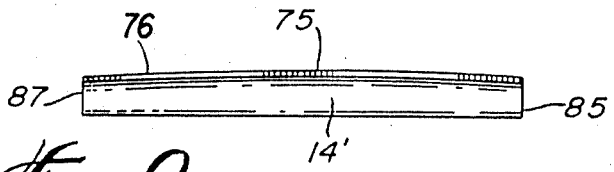
FIG. 9 is a front elevational view of the compacting member.

Referring to FIGS. 7 and 9, a preferred embodiment of the, compacting 14 and associated body unit is shown. As may be seen from FIG. 7, compacting member 14' has an upper surface 76 with the lower surface being formed of a plurality of rib members 81. A leading edge portion 77 of concave surface 12' meets upper surface 76 at an angle slightly less than 90° as indicated by reference numeral 79 which shows that leading edge portion 77 is angled inwardly to form an angle of less than 90 degrees with respect to the upper surface 76. A leading lower edge generally designated by reference numeral 83 extends slightly below ribs 81—i.e. the depth or thickness of compacting member 14' adjacent its leading edge is slightly greater than the remainder of its thickness. Compacting member 14' is preferably formed of a plastics material and due to the thin nature of leading lower edge 83, it is flexible and will fit within the channel wherein compacting member 14' is placed. Thus, a constant upward pressure will be placed on upper leading edge 77 as indicated by arrows 89 in FIG. 8. As will be appreciated, the manufacture of compacting member 14' and body unit 2 is subject to normal manufacturing tolerances. Thus, under normal conditions, it may occur that compacting member 14' has a thickness slightly less than the depth of the channel wherein it is placed to compact the loose tobacco. In the prior art, such occurrences generally led to a poor shearing of any loose tobacco protruding from the cavity or chamber 8. However, with the use of a flexible leading lower edge 83, a good contact between leading upper edge 77 and a cutting edge 15 is maintained.

As shown in FIG. 9, compacting member 14' bulges upwardly from opposed ends 85 and 87 for reasons which will be discussed hereinbelow. Thus, it can be observed in FIG. 9, that the crowned portion 75 is higher than the opposed ends 85 and 87.

As may be seen from FIG. 1, body unit 2 is reinforced about aperture 6. To this end, there is provided a pair of ribs 71 extending about opposite sides of aperture 6. A further pair of ribs 72 and 73 extend between ribs 71 with rib 72 defining the wall adjacent aperture 6 and rib 73 being along the front edge of body unit 2. A plurality of further ribs 74 run between ribs 72 and 73. The use of all the above ribs gives a reinforcement to the area between front edge 4 and aperture 6.

As may be seen from FIG. 1, cutting edge 15 has a V-shaped configuration such that cutting edge 77 on compacting member 14' will have an initial point of contact adjacent the sides and the contact will progress inwardly to the "point" of the V-configuration. In other words, a dual scissors-like action is utilized.

During the contact of edges 77 and 15, essentially a point contact between cutting edges is maintained whereby loose protruding tobacco is sheared. Also, as previously mentioned, the upwardly bevelled surface 76 of compacting member 14' acts to maintain a slightly increasing upward pressure between the cutting edges.

In this respect, a bevel in the order of 0.0005 inch is normally sufficient although a lesser or a greater bevel may be utilized.

It will be appreciated that the above described embodiments are for purposes of illustration only and that changes and modifications may be made thereto without departing from the spirit and scope of the invention. Thus, while there has been described a compacting member which is both bevelled and has a flexible lower leading edge, both of which are adapted to maintain effective contact between the cutting edges, a single one of these means may be effectively employed. Furthermore, although the modfications have been made to certain portions of the compacting member, equivalent changes to the body portion may equally well be employed.

I claim:

1. In a cigarette-making machine having a body portion, a cavity adapted to receive loose tobacco and a compacting member movable in the body portion between first and second positions to compact loose tobacco placed in the cavity, and means to cause movement of said compacting member between the first and second positions; the improvement wherein a cutting edge is formed on said compacting member to meet a cutting edge on said body portion when being moved between said first and second positions, said cutting edge on said body portion having a V-shaped configuration and said cutting edge on said compacting member being a straight edge.

2. The improvement of claim 1 wherein said cutting edge on said compacting member is bowed upwardly from opposite ends of said compacting member towards a center portion of said cutting edge on said compacting member.

3. The improvement of claim 1 wherein said cutting edge of said compacting member has a crowned uppermost portion at the center thereof which curves downwardly toward said opposite ends to maintain a pressure on the cutting edge at least during contact with the cutting edge of the body portion.

4. The improvement of claim 2 wherein said cutting edge of said compacting member has a crowned uppermost portion at the center thereof which curves downwardly toward said opposite ends to maintain a pressure on its cutting edge at least during contact with the cutting edge of the body portion.

5. The improvement of claim 1 wherein said compacting member is slidable in a channel in said body portion between said first and second positions, said cutting edge on said compacting member being an upper and leading edge thereof, a lower leading edge portion of said compacting member being formed so as to be slightly flexible, the compacting member being sized adjacent its leading edges to be slightly larger than said channel such that a spring action of said lower flexible leading edge portion maintains an upwardly exerted pressure on said upper cutting edge.

6. The improvement of claim 2 wherein said compacting member is slidable in a channel in said body portion between said first and second positions, said cutting edge on said compacting member being an upper and leading edge thereof, a lower leading edge portion of said compacting member being formed so as to be slightly flexible, the compacting member being sized adjacent its leading edges to be slightly larger than said channel such that a spirng action of said lower flexible leading edge portion maintains an upwardly exerted pressure on said upper cutting edge.

7. The improvement of claim 1 wherein said body portion has a plurality of exterior side walls and said cavity in said body portion is formed close to one of said side walls thereof, the portion between the cavity and the last named side wall of the body portion being reinforced to minimize structural distortion thereof during operation of said compacting member.

8. The improvement of claim 2 wherein said body portion has a plurality of exterior side walls and said cavity in said body portion is formed close to one of said side walls thereof, the portion between the cavity and the last named side wall of the body portion being reinforced to minimize structural distortion thereof during operation of said compacting member.

9. The improvement of claim 3 wherein said body portion has a plurality of exterior side walls and said cavity in said body portion is formed close to one of said side walls thereof, the portion between the cavity and the last named side wall of the body portion being reinforced to minimize structural distortion thereof during operation of said compacting member.

10. The improvement of claim 1 wherein said compacting member has a concave leading surface and an upper surface and with the upper edge of said compacting member forming said cutting edge, the angle between the upper surface of said compacting member and said concave leading surface being less than 90 degrees.

11. The improvement of claim 2 wherein said compacting member has a concave leading surface and an upper surface and with the upper edge of said compacting member forming said cutting edge, the angle between the upper surface of said compacting member and said concave leading surface being less than 90 degrees.

12. The improvement of claim 3 wherein said compacting member has a concave leading surface and an upper surface and with the upper edge of said compacting member forming said cutting edge, the angle between the upper surface of said compacting member and said concave leading surface being less than 90 degrees.

13. The improvement of claim 1 wherein said body portion has a plurality of exterior side walls and said cavity in said body portion is formed close to one of said side walls thereof, said body portion including a plurality of ribs between the last named side wall of the body portion and the cavity to reinforce the body portion to minimize structural distortion thereof during operation of said machine.

14. The improvement of claim 2 wherein said body portion has a plurality of exterior side walls and said cavity in said body portion is formed close to one of said side walls thereof, said body portion including a plurality of ribs between the last named side wall of the body portion and the cavity to reinforce the body portion to minimize structural distortion thereof during operation of said machine.

15. The improvement of claim 3 wherein said body portion has a plurality of exterior side walls and said cavity in said body portion is formed close to one of said side walls thereof, said body portion including a plurality of ribs between the last named side wall of the body portion and the cavity to reinforce the body portion to minimize structural distortion thereof during operation of said machine.

16. The improvement of claim 1, further including a nozzle member adapted to receive the compacted tobacco and on which nozzle member a tobacco tube is adapted to be received, said nozzle member having an inlet end and an outlet end, at least a portion of a wall defining said inlet end being tapered inwardly to prevent jamming of tobacco when inserted into said tube.

17. The improvement of claim 2, further including a nozzle member adapted to receive the compacted tobacco and on which nozzle member a tobacco tube is adapted to be received, said nozzle member having an inlet end and an outlet end, at least a portion of a wall defining said inlet end being tapered inwardly to prevent jamming of tobacco when inserted into said tube.

18. The improvement of claim 3, further including a nozzle member adapted to receive the compacted tobacco and on which nozzle member a tobacco tube is adapted to be received, said nozzle member having an inlet end and an outlet end, at least a portion of a wall defining said inlet end being tapered inwardly to prevnet jamming of tobacco when inserted into said tube.

19. A cigarette-making machine comprising a body member, a cavity located in said body member adapted to receive loose tobacco, a cutting edge on said body member adjacent said cavity, a compacting member movable between first and second positions to compact loose tobacco placed in said cavity, said compacting member having a concave leading surface, an upper cutting edge at said leading surface and which upper cutting edge is adapted to cut loose tobacco in conjunction with said cutting edge on said body member adjacent said cavity, means for moving said compacting member between said first and second positions to compact loose tobacco into an elongated cylindrical form, means for retaining a hollow cigarette tube in a position to receive the elongated cylindrical form of tobacco, and a spoon member for injecting said compacted form of tobacco into said hollow cigarette tube, at least one of said cutting edges having a V-shaped configuration such that during a cutting operation, the cutting edges progressively contact each other in a dual scissors-like cutting action.

20. The machine of claim 19 wherein the cutting edge on said compacting member is a straight edge and the cutting edge on said body portion has a V-shaped configuration.

21. The machine of claim 20 wherein said compacting member is arched upwardly and has a crowned uppermost center portion which curves downwardly toward a pair of its opposed ends so as to maintain in a slightly increasing pressure on the cutting edges.

22. The machine of claim 19 wherein said leading surface of said compacting member has a lower leading edge portion extending downwardly and outwardly, said lower leading edge portion being at least slightly flexible and being sized to exert an upward pressure on said cutting edge of said compacting member.

23. The machine of claim 20 wherein said leading surface of said compacting member has a lower leading edge portion extending downwardly and outwardly, said lower leading edge portion being at least slightly flexible and being sized to exert an upward pressure on said cutting edge of said compacting member.

24. The machine of claim 21 wherein said leading surface of said compacting member has a lower leading edge portion extending downwardly and outwardly, said lower leading edge portion being at least slightly flexible and being sized to exert an upward pressure on said cutting edge of said compacting member.

25. In a cigarette-making machine having a body member, a cavity adapted to receive loose tobacco and a compacting member slidably movable within a channel in said body member between first and second positions to compact loose tobacco placed in the cavity, and means to cause movement of said compacting member between the first and second positions; the improvement wherein the main portion of said compacting member has a height equal to or slightly less than the height of said channel within which it is movable so as to be easily movable therein, and said compacting member having a second portion with a height slightly greater than the depth of channel, said second portion of said compacting member being flexible such that it will fit within said channel and maintain a pressure between a cutting edge on said compacting member and another cutting edge.

* * * * *